US006661979B2

(12) United States Patent
Barlow

(10) Patent No.: US 6,661,979 B2
(45) Date of Patent: Dec. 9, 2003

(54) SYSTEM AND METHOD FOR DETECTING LOW PAPER IN A PRINTER USING CONTINUOUSLY VARIABLE MEASUREMENTS

(75) Inventor: Michael L. Barlow, Duluth, GA (US)

(73) Assignee: NCR Corporation, Dayton, OH (US)

( * ) Notice: Subject to any disclaimer, the term of this patent is extended or adjusted under 35 U.S.C. 154(b) by 25 days.

(21) Appl. No.: 10/025,933

(22) Filed: Dec. 19, 2001

(65) Prior Publication Data

US 2003/0113124 A1 Jun. 19, 2003

(51) Int. Cl.[7] ..... G03G 15/00
(52) U.S. Cl. ..... 399/23; 271/258.04
(58) Field of Search ..... 399/16, 23, 24, 399/381, 389, 391, 393; 347/105, 153, 215, 264; 271/9.03, 258.01, 258.04, 259

(56) References Cited

U.S. PATENT DOCUMENTS 4,885,613 A * 12/1989 Kudoh ..... 399/23
4,928,949 A * 5/1990 Ramsey et al. ..... 271/258.04 X
4,974,019 A * 11/1990 Nishioka et al. ..... 399/23
5,629,672 A * 5/1997 Brown et al. ..... 399/23 X
6,000,871 A * 12/1999 Fisher, Sr. ..... 271/258.01 X
6,206,594 B1 * 3/2001 Elgee et al. ..... 271/258.01 X
6,295,081 B1 * 9/2001 Kashima et al. ..... 347/264 X

* cited by examiner

*Primary Examiner*—Sandra Brase
(74) *Attorney, Agent, or Firm*—Maginot, Moore & Bowman LLP

(57) ABSTRACT

A system determines the level of paper available in paper supply for printing. The system comprises a signal emitter and a variably activated receiver. The receiver alters an electrical parameter such as a resistance in accordance with the portion of the emitted signal received at the receiver. This alterable electrical parameter is in an electrical circuit that generates a signal proportional to the received portion of the emitted signal. An array of variably activated receivers may be arranged opposite a signal emitter to receive the signal portion not blocked by a paper supply. Alternatively, the array of variably activated receivers may be located adjacent to the signal emitter to receive the portion of the emitted signal reflected from the paper supply. The receiver uses the received or reflected signal to generate a signal having a magnitude proportional to the received or reflected signal. The signal from each of the receivers may be summed to generate a signal with a magnitude range that corresponds to the full and empty conditions of the paper supply at its extremes. Thus, the system of the present invention is able to provide a continuously variable signal indicative of the available paper in the supply over its entire range.

20 Claims, 4 Drawing Sheets

SYSTEM AND METHOD FOR DETECTING LOW PAPER IN A PRINTER USING CONTINUOUSLY VARIABLE MEASUREMENTS

FIELD OF THE INVENTION

This invention relates generally to methods and systems for detecting low paper in a printer and, more particularly, to methods and systems for detecting multiple levels of paper supply in a printer.

BACKGROUND OF THE INVENTION

Printers are used for depositing indicia on paper to produce documents and the like. The paper on which the indicia are deposited or printed may be provided to the printer in separate sheets or in continuous form such as a roll or fan-folded sheets. The paper on which the indicia are printed is typically provided in a supply unit such as a well, cassette, recess, or the like as is well known. To prevent the operation of the printer when no paper is available for receiving the indicia, detectors were developed that sensed the absence of available paper in a supply unit and provided an indicator of the paper unavailable condition so an operator could replenish the supply. Because the condition of the paper supply is sensed prior to the printing mechanism for depositing the indicia, the paper unavailable condition could occur during the printing of a multiple page document. Also, printing of a document on a roll of paper might also commence before detection of the end of the paper roll by the supply detector. To prevent the likelihood that a paper supply would be exhausted during a printing operation, low paper condition detectors were developed.

Low paper condition detectors monitor the paper supply unit and determine when the paper supply has reached a predetermined threshold and signals a low paper condition without terminating an ongoing printing operation. At the conclusion of the ongoing printing operation, if it finishes before the supply is exhausted, the operator may then replenish the paper supply to prevent the subsequent interruption of a later printing operation for the lack of paper. Thus, low paper condition detectors facilitate the scheduling of paper supply replenishment at a time that is not likely to interfere with an ongoing printing operation. To further facilitate paper supply replenishment scheduling or to assist an operator in determining whether sufficient paper is available for the printing of a multiple page document or a long document, detectors for providing multiple indications of the paper supply level were developed. These detectors typically include multiple sensors that detect the presence or absence of paper in the vicinity of a sensor. When the multiple sensors are arranged along the depth of a stack of paper sheets in a supply or along the radius of a paper roll supply, the two adjacent sensors that detect opposite conditions provide an indication of the paper supply condition. That is, a sensor indicating no paper is present and an adjacent sensor that indicates paper is present demarcates an approximate boundary of the paper supply. For example, four sensors equally spaced in longitudinal array along the depth of a paper supply or the radius of a paper roil may have second and third sensors indicating opposite conditions. From the signals from the sensors, a controller or processor may determine that the paper supply is between 50% and 75% full. When all four of the sensors indicate the presence of paper, the supply is full, while all four sensors indicating the absence of paper indicates the supply is below the last sensor in the array. This last condition is typically used to signal a low paper condition and the other possible signals from the detector are used to determine the approximate level of the paper supply for determining whether substantial printing operations may be performed without exhausting the available paper supply.

While the detectors that provide multiple indications of the status of a paper supply are useful, they do not provide a continuous indication of the level of the paper supply available. To address this deficiency, a low-paper sensing device was disclosed in U.S. Pat. No. 5,960,230 to Peter. The device of that paper uses a sensor of the type described above to indicate more than one level of paper supply and supplements this paper level indication by counting the number of sheets of paper delivered to a printer from the supply between detection of level indications. This data may then be used to count down to an empty condition or to calculate an approximate number of sheets left in the supply. Thus, this device requires the addition of a counting mechanism to the printer paper supply unit to more accurate assess the status of the printer paper supply between level indications.

One limitation of the above-described device is the requirement for a sheet counter. In printers that use paper sheets, additional counter circuitry and software for adjusting the sheet count through averaging and the like to compensate for some measurement errors is required. For printers that use paper roll supplies, the counter does not successfully indicate the amount of paper remaining because it is not provided in a sheet by sheet manner.

Consequently, what is needed is a way of continuously indicating the status of the paper supply.

What is need is a way of refining measurements of available paper for printing without requiring the counting of sheets.

SUMMARY OF THE INVENTION

The above-noted limitations of previously known systems and methods for indicating the level of available paper in a paper supply for a printer have been overcome by a system and method that operate in accordance with the with principles of the present invention. The system of the present invention comprises a signal emitter for emitting a signal into a paper supply and a variably activated receiver for generating a paper supply level signal, the variably activated receiver is mounted at a location for selectively receiving the emitted signal from the signal emitter in relation to the level of paper in the supply. The signal emitter may be an infrared (IR) or electrical source. The variably activated receiver is preferably a photoresistor having a resistor value that changes in accordance with the amount of infrared radiation received at the surface of the photoresistor. The photoresistor is coupled to a signal circuit that generates a continuously variable signal across a range and the signal variation follows the resistance value of the photoresistor. The variably activated receiver has sufficient length such that only a portion of the receiver is exposed to the signal emitter as the paper supply between the emitter and receiver diminishes. When the length of the receiver is fully exposed to the signal emitter, the receiver generates a saturation signal that defines one end of the range of the signal generated by the receiver.

In an alternative embodiment of the present invention, a light guide is interposed between the variably activated receiver and the signal emitter. The light guide collects the infrared signal emitted by an optical signal emitter and transmits the light to a variably activated sensor. As a longer section of light guide is exposed to the optical signal emitter, more light is delivered to the surface of the variably activated receiver. The intensity of the delivered light causes a parameter of the receiver to vary and generate a continuously variable signal indicating the relationship between the signal emitter, light guide, and paper in the paper supply.

The method of the present invention includes emitting a signal into a paper supply and generating a continuously variable signal indicative of the amount of emitted signal being received by a variably activated receiver coupled to a paper supply. Preferably, the emitted signal is an infrared signal and the continuously variable signal is indicative of the amount of light incident upon the variably activated receiver. The method of the present invention may also include coupling the emitted signal through a light guide to the variably activated receiver. A length of light guide, a continuous light source, or array of discrete light sources may be provided along the length of the paper to continuously provide an amount of light indicative of the amount of available paper in a paper supply.

Because the system and method of the present invention may be used to generate a continuously variable signal indicative of the paper supply level, a user may specific a low paper condition level anywhere along the range of the supply capacity. Thus, the low paper condition detector need not be physically arranged to correspond to the desired level for generation of a low paper condition signal. Instead, a user may enter the low paper condition through a software interface and the control program for the printer may store the low paper condition parameter for comparison with the signal indicative of the paper supply level. Additionally, with data regarding the length of a standard roll or thickness of a sheet, the system and method of the present invention may be used to compute a remaining number of sheets or roll length for display to an operator. In this manner, a continuous indication of the paper supply is provided for operator control of the printer and printer supply replenishment.

It is an object of the present invention to provide a continuously variable signal indicative of paper supply level in a printer.

It is an object of the present invention to support user definition of the low paper condition level without requiring mechanical adjustment of the paper supply sensors.

It is an object of the present invention to provide continuously variable indicator of the remaining paper supply in a printer.

These and other advantages and features of the present invention may be discerned from reviewing the accompanying drawings and the detailed description of the invention.

BRIEF DESCRIPTION OF THE DRAWINGS

The present invention may take form in various system and method components and arrangement of system and method components. The drawings are only for purposes of illustrating an exemplary embodiment and are not to be construed as limiting the invention.

DETAILED DESCRIPTION OF THE INVENTION

Figure 1:
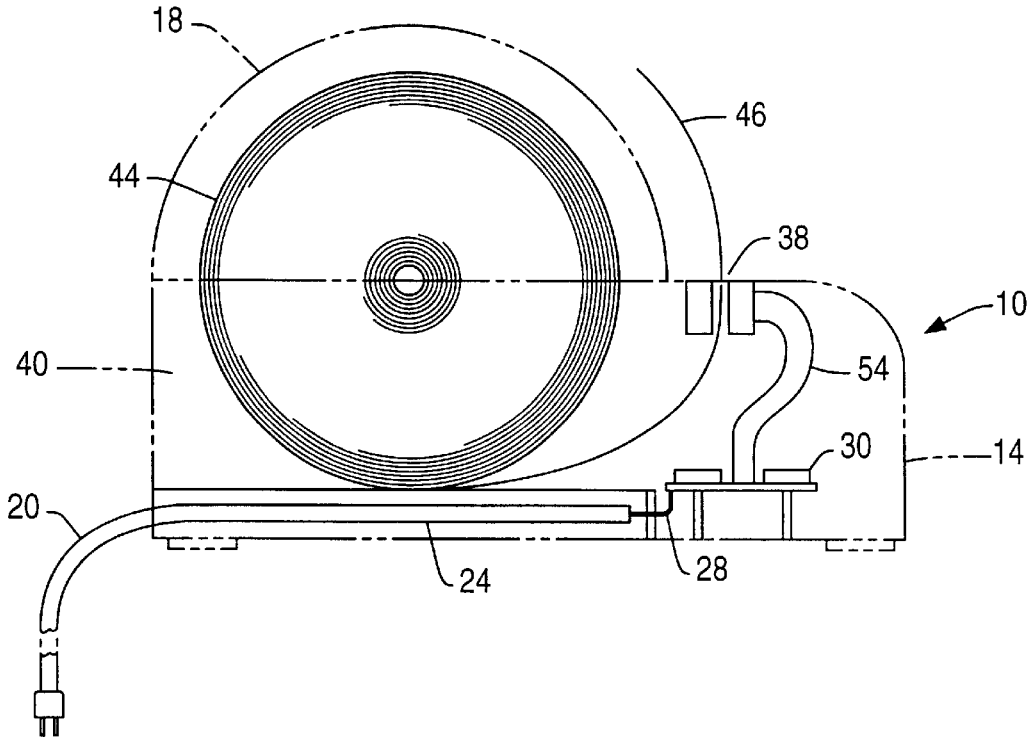
FIG. 1 depicts a side view of a receipt printer in which the present invention may be used.

A receipt printer incorporating the system and method of the present invention is shown in FIG. 1. Printer 10 includes a housing 14, and a paper supply cover 18. Mounted to extend from housing 14 is a power cord 20 for coupling printer 10 to a power source for operation of the printer. Power cord 20 is coupled to a power card 24 for stepping down and rectifying the voltage of the power source for use with the electronics of printer 10. The electronics for controlling the operation of printer 10 are mounted on printed circuit card 30. The electronics may include an application specific integrated circuit (ASIC) or a microcontroller having volatile and programmed memory. The electronics are coupled to printer mechanism 38 through signal cable 34. Formed within housing 14 is a paper well 40 for holding a paper roll 44. Paper roll 44 may be dropped into well 40 so it freely spins about its axis or paper roll 44 may be formed about a spindle and mounted within spindle holders on each side of well 40. Free end 46 of roll 44 is moved proximate printer mechanism 38 so indicia may be placed on the surface of the paper facing printer mechanism 38. Printer 10 also includes a cable connector mounted to housing 14 so printer 10 may be coupled to a host computer for receiving control signals and a datastream for printing. Internal to housing 14, the connector is coupled to PC card 30 so the microcontroller or ASIC may respond to the control signals and deliver the datastream to printer mechanism 38 through signal cable 34 so the datastream may be printed on the paper or media disposed in well 40.

Figure 2A:
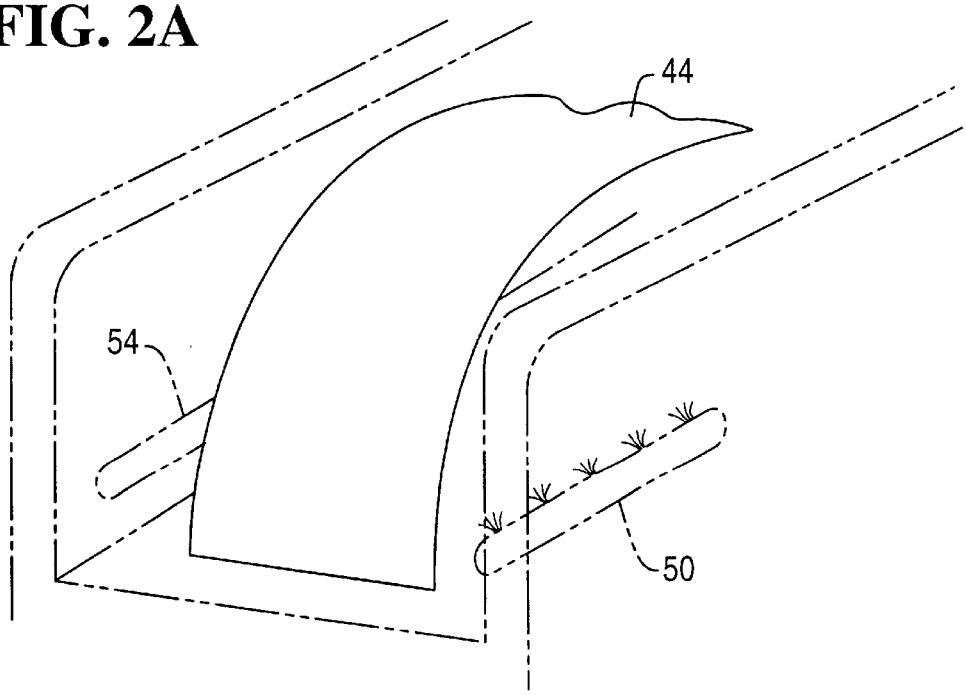
FIG. 2A depicts the receipt printer of FIG. 1 with the signal emitter and receiver of the present invention mounted therein.

The system and method of the present invention may be incorporated in printer 10 by mounting a signal emitter 50 in well 40 in conjunction with an variably activated receiver 54 as shown in FIG. 2A. The signal emitter may be an optical or electrical signal generator comprised of an array of such emitters or a single emitter. Preferably, the emitter is an infrared source, such as a light emitting diode (LED), for directing a light or other infrared signal into a paper supply when paper well 40 contains a full paper roll. Preferably, the emitter or emitter array extends from the center of roll 44 and is aligned along the radius of paper roll 44. Mounted on the opposing wall of well 40 in horizontal alignment with emitter 50 is a variably activated receiver 54. Variably activated receiver 54 is any infrared receiver that alters an electrical parameter in proportion to the amount of incident infrared energy that contacts the receiver surface. Preferably, receiver 54 is a photoresistor that alters the electrical resistance of the receiver in proportion to the amount of light sensed by receiver 54. Receiver 54 may also be an array of multiple receivers 54*a*–54*n* that covers substantially all of the radius of paper roll well 44 or the depth of a paper stack well.

Figure 2B:
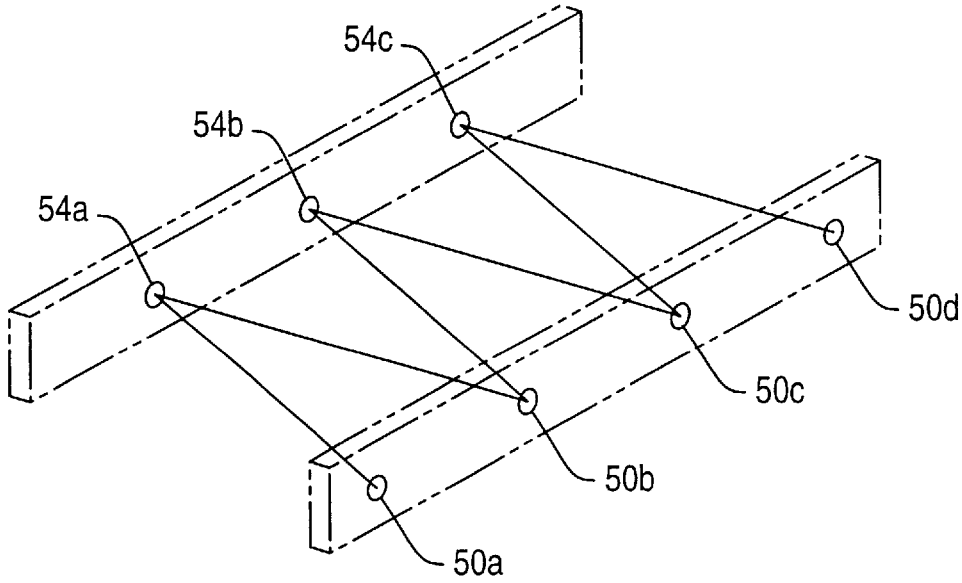
FIG. 2B depicts an alternative arrangement of the signal emitter array and receiver of the present invention.
Figure 3:
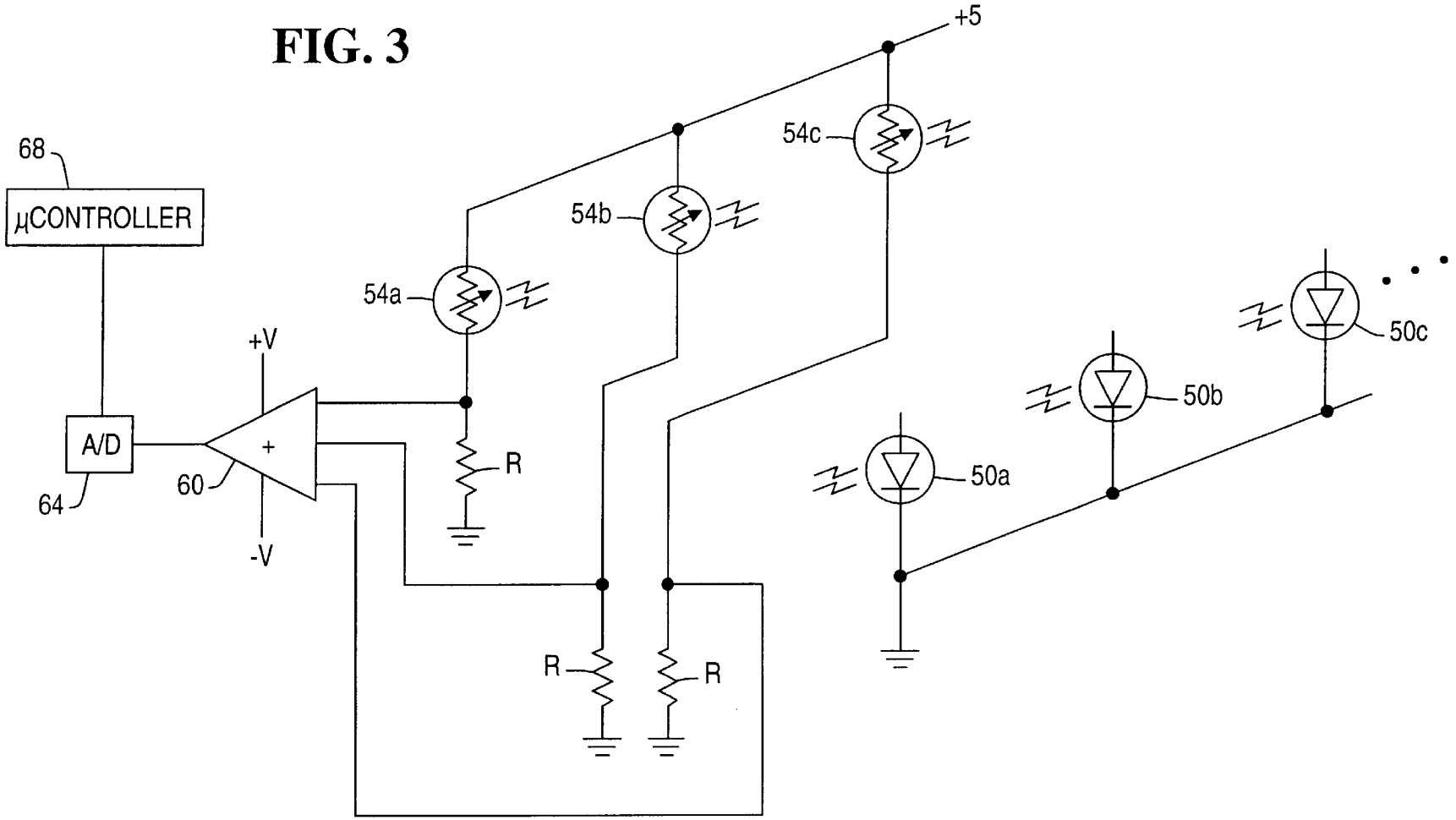
FIG. 3 depicts a circuit diagram of the low paper detector of the present invention.
Figure 4:
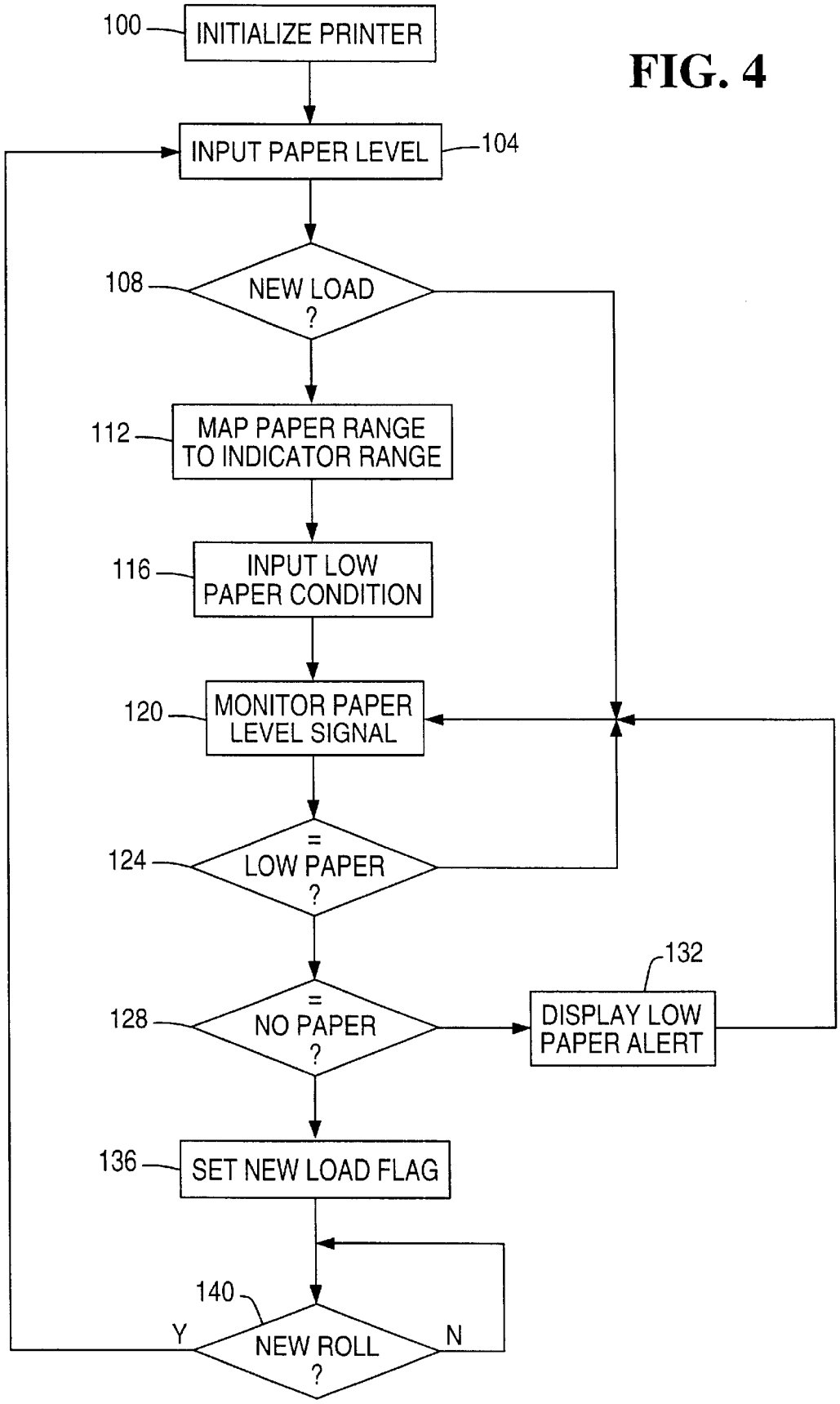
FIG. 4 is a flowchart of an exemplary method for indicating the status of paper within a paper supply for the printer of FIG. 1.

If the photoresistor is an elongated receiver having a length that covers a substantial portion of the radius between two signal emitters 50*a* and 50*b* (FIG. 3). The amount of light incident on such a receiver 54 is proportional to the amount of photoresistor exposed to the emitter directly across from the receiver. As roll 44 is used, its perimeter retracts towards its center and exposes more of receiver 54 to the light from emitter 50. As the amount of light incident on receiver 54 increases, the electrical parameter associated with the receiver is altered, as explained below, this alteration generates a signal indicative of the paper level in well. 40. The generated signal has a magnitude that is proportional to the infrared or other emitted signal incident on receiver 54. For emitters and receivers that are more aptly described as point sources and receivers, the receivers are mounted in a staggered arrangement so they are located between two adjacent emitters as shown in FIG. 2B. Preferably, the receivers are mounted at a location approximately halfway between the two emitters although other staggered arrangements may be used. As light spreads out from emitter 50*a*, it increasingly impinges upon receiver 54*a* as paper roll 44 retracts. When the perimeter of roll 44 is just past the receiver 54*a*, light spreading from emitter 50*a* is striking the receiver without any blockage from paper roll 44. However, the light striking receiver 54*a* is at an angle and the amount of energy in such angled light does not saturate receiver 54*a*. As paper roll 44 further retracts, light from emitter 50*b* begins to strike the receiver until roll 44 fully exposes emitter 50*b*. At that point, the receiver 54*a* is receiving angled light from the two most recently exposed emitters, 50*a* and 50*b*. The sum of this incident energy is sufficient to saturate the point receiver so its contribution to the paper level signal is maximized.

A circuit diagram depicting an exemplary system of the present invention is shown in FIG. 3. Emitters 50*a*, 50*b*, and 50*c* are coupled together in a parallel circuit so they continually emit light while printer 10 is being powered. Each receiver 54*a*, 54*b*, and 54*c* are in coupled in series with a fixed resistor R. One end of all the receivers are coupled to power and each resistor R is coupled to system ground. The node between a resistor R and a receiver provides a voltage divider signal that is proportional to the resistance of a receiver 54. As described above, the resistance of receiver 54 is proportional to the incident energy on its surface. As this resistance changes so does the level of the signal at the voltage divider node. The signal from each such node is provided to summing amplifier 60 to generate a single signal that represents the sum of the node signals. This summing signal has a magnitude that is proportional to the amount of energy incident on receiver 54 and this signal is provided to an analog/digital converter that supplies a digital value to microcontroller 68 or other control component used to operate printer 10.

If receivers 54*a*, 54*b*, and 54*c* are photoresistors that alter a resistance from a high value with little incident energy to a low value at its maximum energy input, then the signals at the nodes are approximately equal to zero at low energy and equal to some percentage of the source level at high energy levels. The level of the signal at high energy levels depends upon the ratio of the resistor R to the low resistance of the photoresistor at the high energy levels. For example, the value of R and the range of resistance for the photoresistors may be selected so that ⅓ of the source voltage is present at a node when the maximum energy is incident on the surface of a receiver. Thus, when all of the receivers have maximum energy incident on their surfaces, three signals equal to one third of the source voltage are provided to amplifier 60. These signals cause amplifier 60 to generate a signal that is approximately equal to the source voltage, although the output of summing amplifier 60 may be offset so the range of its output signal varies over the range defined by the positive and negative values of the source voltage.

One advantage of the present invention is the detection of a paper roll loading by detecting the fully exposed condition of receiver 54 when roll 44 is removed and the initial condition of receiver 54 when a supply roll is placed well 40. Typically, the replacement roll is a full supply roll and receiver 54 is fully blocked from emitter 50. Thus, the range of the signal generated by summing amplifier 60 represents the level of paper present in well 44 from a full roll to an empty roll. However, when a partially full roll is placed in well 44, the output of amplifier 60 represents the "full" supply condition. The system of the present invention permits microcontroller 68 to adjust the range of operation of amplifier 60 so the full range of its operation is mapped to the full and empty conditions of the paper supply currently in well 44. This permits partially used rolls to be saved and later used. For example, if a user sets the low paper condition at 20% of a roll, the operator may change out the roll when the low paper condition is signaled. Later, the 20% roll may be loaded in printer 10 and microcontroller 68 may adjust the operation of amplifier 60 so that a low paper condition is signaled when only 20% of the partially used roll is left.

In an alternative embodiment, a single receiver 54 may be provided at the end of an emitter signal conduit. The conduit is arranged to oppose emitter 50 as described above. As the conduit is exposed by the retracting paper roll, more emitted signals impinge upon the conduit that conducts the emitted signals to receiver 54 for altering the electrical parameter. The conduit may be any known material that permits light to enter the conduit through its sidewall and then reflect the light through a passageway internal to the conduit so it may be delivered to the selectively activated receiver. One example of a conduit that may be used to provide infrared energy in the visible light spectrum to a photoresistor or the like is a light guide such as that manufactured by CUDA Fiberoptics and having part number S8-36FS-G.

Figure 2C:
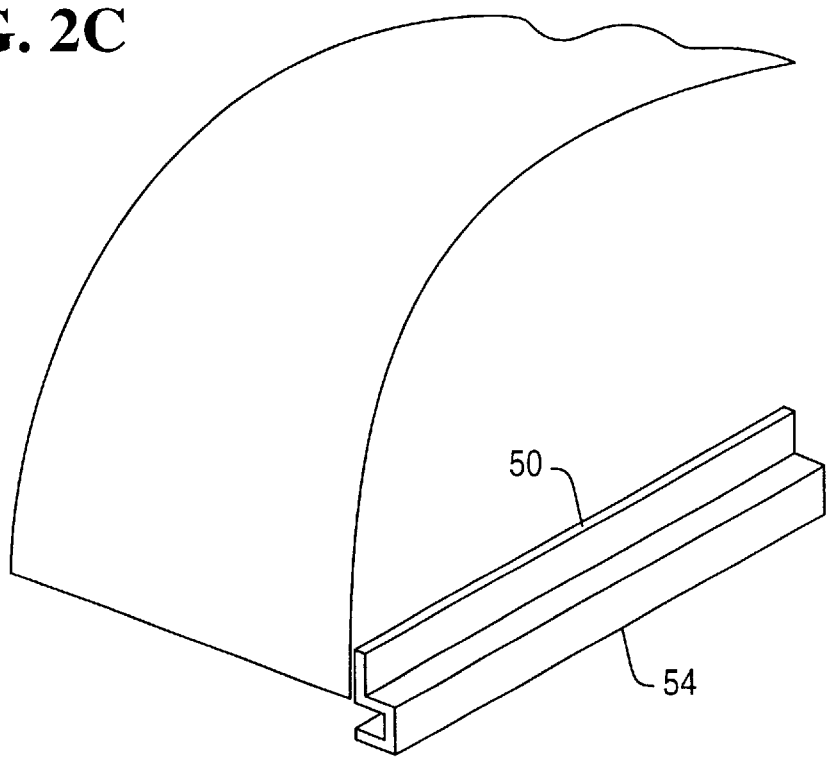
FIG. 2C depicts another alternative arrangement of the signal emitter array and receiver of the present invention.

In yet another alternative embodiment, receiver 54 may be mounted on the same side of well 40 as emitter 50. In this arrangement, shown in FIG. 2C, signals from emitter 50 are reflected off of roll 44 into receiver 54. As paper roll 44 retracts, less radiant energy is reflected from roll 44 into receiver 54. Accordingly, the total radiant energy impinging upon receiver 54 is greatest at a full roll condition and least at an empty roll condition. Again, this energy range may be used to alter an electrical parameter such as the resistance of a photoresistor that is used to vary a signal indicative of the paper level in well 44. Also, the initial value of the radiant energy at receiver 54 following an exhausted supply condition may be used to map the radiant energy range over the operational range of amplifier 60 for more refined measurement of the remaining capacity of roll 44.

The method of the present invention uses the continuously varying signal indicative of the paper supply to signal a low paper condition for printer 10. The software executing the method may be programmed in the instructions for controlling microcontroller 68 or an ASIC. The method follows initialization of printer 10 (block 100) and is periodically executed during operation of printer 10. Following initialization (block 100), the signal indicative of the paper supply level is input (block 104) and a determination is made as to whether a new roll is being installed or printer 10 has been powered up with a supply roll in well 44 (block 108). If a new roll has been loaded, the initial signal indicating the "full" supply condition is mapped to the operational range of the paper level signal converter (block 112). The operator may then identify a low paper condition value (block 116). The low paper condition value may be entered through a computer or terminal coupled to printer 10, a switch selectable option on the panel of printer 10, or through a digital display of printer 10. To receive the low paper condition value from a computer, the computer is coupled to the connector of printer 10 for receiving control signals and datastreams. The printer control program in the computer may be adapted to receive a low paper condition from a user. Preferably, this value is expressed as a percentage of the media supply although it may be specified in linear units of measurement, number of sheets, or media supply units. This value may then be included in the control signals for processing by the microcontroller. In response, the microcontroller uses the received value to set the low paper condition for printer 10 operation and may display the low paper condition value in the display at printer 10 to provide a visual confirmation signal to the user. The program controlling the microcontroller or ASIC may also include instructions for responding to a request from the computer coupled to printer 10 for a media remaining value. Because the microcontroller or ASIC monitors the paper level signal as described below, it may compute the amount of remaining paper or other media and send a data message to the computer that contains the remaining paper level value. The computer may use this value for scheduling print jobs or other computer operations. This operation also allows the computer to alter the low paper condition value to efficiently control usage of the paper supply in well 40.

Alternatively, the low paper condition value may be entered at printer 10. In this embodiment, microcontroller 68 may display a default low paper condition value as a number representing a percentage of a full supply in a digital display (not shown). A user may then use a up/down switch to increment or decrement the displayed value to a percentage other than the one displayed. Alternatively, the low paper condition may be defined as a linear measurement of remaining paper provided microcontroller 68 includes a program for calculating remaining paper in linear measurement units. Such a program would have to correlate the range of the signal indicative of the paper supply level to the range of available paper length from zero to its maximum length.

Once the operational range and low paper condition are defined, the paper level signal is monitored (block 120) and compared to the low paper condition value (block 124). This operation continues until the paper level signal indicates the low paper condition has been reached or exceeded (block 124). When the low paper condition is reached, a determination is made as to whether the paper supply has been exhausted (block 128). If it has not been exhausted, the low paper signal is illuminated or sounded (block 132) and the monitoring of the paper level signal continues (block 120). Otherwise, a flag is set to indicate a new paper roll is required (block 136). Once a new roll is detected (block 140), the initial paper roll condition is read (block 104) and used to reset the operational range of the low paper detector and any change in the low paper condition may also be set by the operator.

While the present invention has been illustrated by the description of exemplary processes and system components, and while the various processes and components have been described in considerable detail, it is not the intention of the applicant to restrict or in any limit the scope of the appended claims to such detail. Additional advantages and modifications will also readily appear to those skilled in the art. For example, the present invention has been described as using infrared emitters and receivers but the invention may also be implemented by measuring a capacitance between an electrode contacting the perimeter of the roll and an electrode at the core of the roll. Another alternative within the scope of the present invention is to generate a continuously varying signal in accordance with the deflection of a piezoelectric device operatively coupled to the paper roll. Also, the principles of the present invention may be applied to printer supplies that contain paper sheets rather than a paper roll or to other media than paper. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for detecting a low paper condition for a roll printer paper supply comprising:

a signal emitter for emitting a signal into a paper supply well, the signal emitter extending from a center and aligned along a radius of a paper roll for the roll paper supply well; and a variably activated receiver for generating a paper supply signal, the variably activated receiver being mounted at a location for selectively receiving the emitted signal from the signal emitter in relation to a level of the paper roll in the roll paper supply well.

2. The system of claim 1 wherein the signal emitter is an infrared source and the variably activated receiver is mounted opposite the signal emitter with the paper supply interposed between the signal emitter and the variably activate receiver.

3. The system of claim 1 wherein the signal emitter is an infrared source and the variably activated receiver is mounted to receive reflected infrared radiation from the signal emitter.

4. The system of claim 1 wherein the variably activated receiver is comprised of a plurality of point receivers in a staggered arrangement.

5. The system of claim 1 wherein the variably activated receiver is comprised of at least one photoresistor.

6. The system of claim 5 further comprising a conduit for coupling the emitted signal from the signal emitter to the variably activated receiver, the conduit being mounted at a location for selectively receiving the emitted signal from the signal emitter in relation to the level of the paper roll in the roll paper supply well.

7. The system of claim 6 wherein the conduit is a light guide.

8. The system of claim 1 wherein the receiver is comprised of a plurality of variably activated receivers arranged in an array and further comprising a signal converter for receiving a signal from each of the receivers in the array of variably activated receivers for generating a signal indicative of the level of paper roll in the roll paper supply well.

9. The system of claim 8 wherein the signal converter is coupled to a microcontroller, the microcontroller for monitoring the signal indicative of the paper level and generating a low paper alert in response to the paper level signal falling below a low paper condition value.

10. The system of claim 1 wherein the signal converter is a summing amplifier.

11. A method for detecting a low paper condition for a roll printer paper supply comprising:

emitting a signal into a paper supply well, the signal emitted from a signal emitter extending from a center and aligned along a radius of a paper roll for the roll paper supply well;

receiving a portion of the emitted signal; and generating a paper supply signal having a magnitude that corresponds to the received portion of the emitted signal.

12. The method of claim 11 wherein the signal emission emits an infrared signal and the emitted signal portion is a portion of the infrared signal that passes by a paper supply in the paper supply well.

13. The method of claim 11 wherein the signal emission emits an infrared signal and the emitted signal portion is a portion of the infrared signal reflected from a paper roll in the roll paper supply well.

14. The method of claim 11 wherein the receipt of the emitted signal portion includes arranging a plurality of point receivers in a staggered arrangement with respect to a plurality of signal emitters to receive a portion of the emitted signal.

15. The method of claim 11 further comprising altering a resistor in an electrical circuit in accordance with the portion of the received emitted signal.

16. The method of claim 15 further comprising coupling the received portion of the emitted signal to a variably activated receiver for generating the paper supply signal.

17. The method of claim 15 further comprising coupling a light guide to a variably activated receiver to direct the received portion of the emitted signal to the variably activated receiver.

18. The method of claim 11 further comprising: arranging a plurality of variably activated receivers in an array to receive the portion of the emitted signal; and receiving a signal from each of the receivers in the array of variably activated receivers to generate the paper supply signal.

19. The method of claim 18 further comprising: monitoring the paper supply signal; and generating a low paper alert in response to the paper level signal falling below a low paper condition value.

20. The method of claim 18 further comprising: receiving a low paper condition value from a computer coupled to the printer in which the paper well is housed; and setting the low paper condition value for operation of the printer in accordance with the low paper condition value received from a computer coupled to the printer.

* * * * *

UNITED STATES PATENT AND TRADEMARK OFFICE

CERTIFICATE OF CORRECTION

PATENT NO. : 6,661,979 B2
DATED : December 9, 2003
INVENTOR(S) : Barlow, M.

It is certified that error appears in the above-identified patent and that said Letters Patent is hereby corrected as shown below:

Column 8,
Line 14, after “a”, second occurrence, insert -- roll --.
Line 25, delete “supply” and substitute -- roll --.
Line 27, delete “activate” and substitute -- activated --.
Line 50, after “of”, second occurrence, insert -- the --.
Line 60, after “a” insert -- roll --.

Column 9,
Line 3, delete “supply” and substitute -- roll --.
Line 4, after “the” insert -- roll --.

Signed and Sealed this

Thirteenth Day of April, 2004

JON W. DUDAS
*Acting Director of the United States Patent and Trademark Office*